US007611427B1

(12) United States Patent
Cline

(10) Patent No.: US 7,611,427 B1
(45) Date of Patent: Nov. 3, 2009

(54) METHOD, SYSTEM, AND APPARATUS FOR PROVIDING MULTI-PLAYER COMPETITIVE RECREATION

(75) Inventor: Michael Cline, Alpharetta, GA (US)

(73) Assignee: Michael L. Cline, Alpharetta, GA (US)

( * ) Notice: Subject to any disclaimer, the term of this patent is extended or adjusted under 35 U.S.C. 154(b) by 297 days.

(21) Appl. No.: 11/503,675

(22) Filed: Aug. 14, 2006

Related U.S. Application Data

(60) Provisional application No. 60/707,777, filed on Aug. 12, 2005.

(51) Int. Cl.
*A63B 67/00* (2006.01)
*A63B 67/02* (2006.01)

(52) U.S. Cl. ..... 473/465; 473/478; 473/459

(58) Field of Classification Search ..... 473/469, 473/466, 478, 465, 415, 472, 471, 459; D21/797; 52/2.13, 2.17
See application file for complete search history.

(56) References Cited

U.S. PATENT DOCUMENTS 3,312,471 A * 4/1967 Nissen ..... 473/469
3,339,925 A * 9/1967 Nissen ..... 473/469
4,815,153 A * 3/1989 Bleser et al. ..... 5/98.1
5,546,707 A * 8/1996 Caruso ..... 52/2.13
5,570,544 A * 11/1996 Hale et al. ..... 52/2.18
5,624,122 A * 4/1997 Winkelhorn ..... 473/471
5,678,357 A * 10/1997 Rubio et al. ..... 52/2.17
5,720,678 A * 2/1998 Korthauer ..... 473/415
5,833,557 A * 11/1998 Cole ..... 473/472
5,865,693 A * 2/1999 Johnson ..... 473/478
7,037,220 B1 * 5/2006 Gordon ..... 473/466

* cited by examiner

*Primary Examiner*—Gene Kim
*Assistant Examiner*—M Chambers
(74) *Attorney, Agent, or Firm*—Hope Baldauff Hartman, LLC

(57) ABSTRACT

A method, system, and apparatus provide multiple players with a unique competitive game. According to one implementation described herein, a game partition has opposing side edges, a top edge, and a bottom edge. Transparent or translucent partition material spans the area defined by these edges and includes at least one aperture sized to allow a game ball to pass through. The game partition may include numerous apertures of various shapes and sizes. The game partition may be utilized in conjunction with a trampoline or inflatable jumping device to provide teams of players to attempt to tag opposing players with balls thrown through the apertures in the game partition while maneuvering on the jumping surface. According to one implementation, points are scored and accumulated according to point values assigned to each aperture when a ball is thrown through an aperture and tags an opposing player.

9 Claims, 7 Drawing Sheets

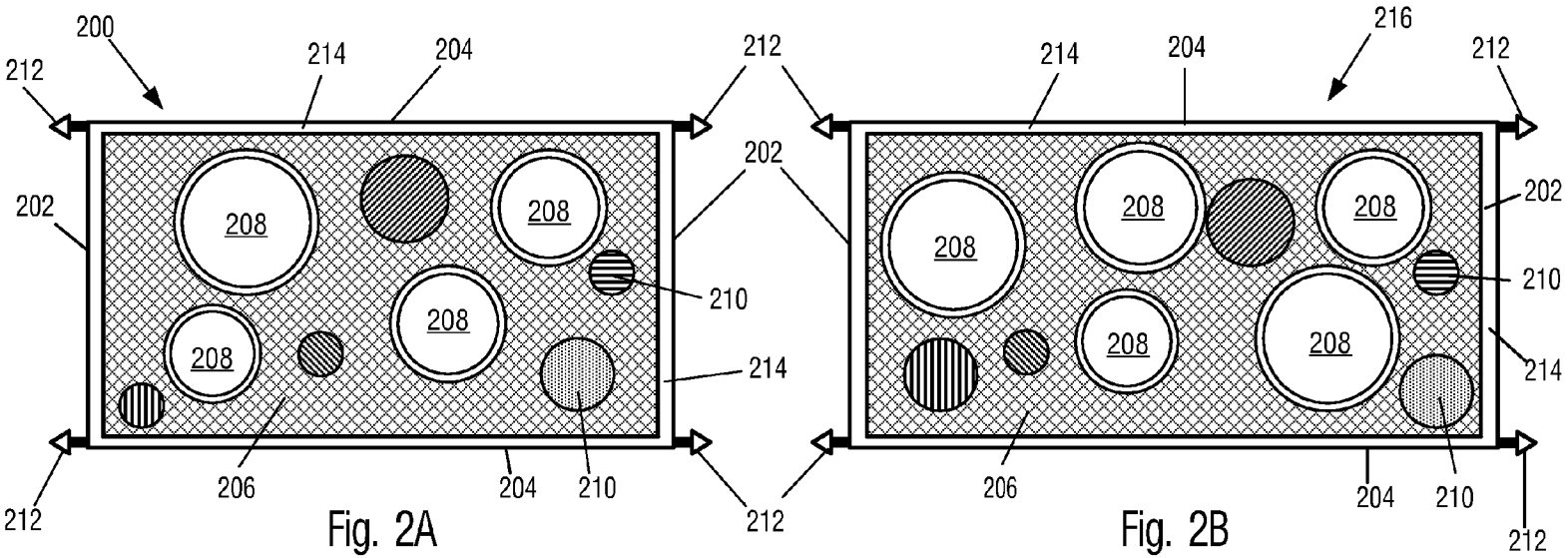
Fig. 2A
Fig. 2B
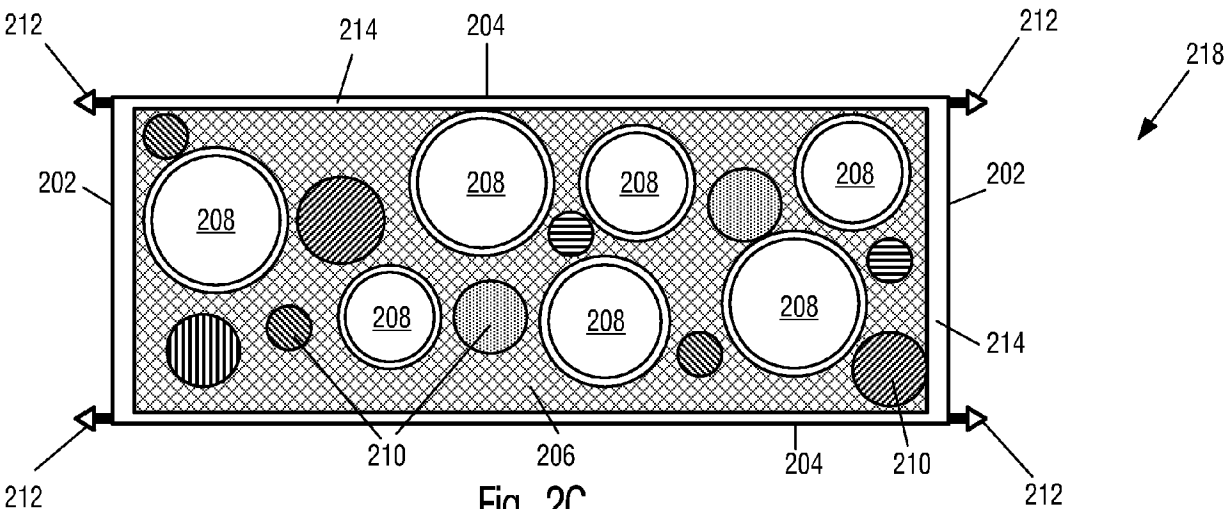
Fig. 2C

Fig. 5A
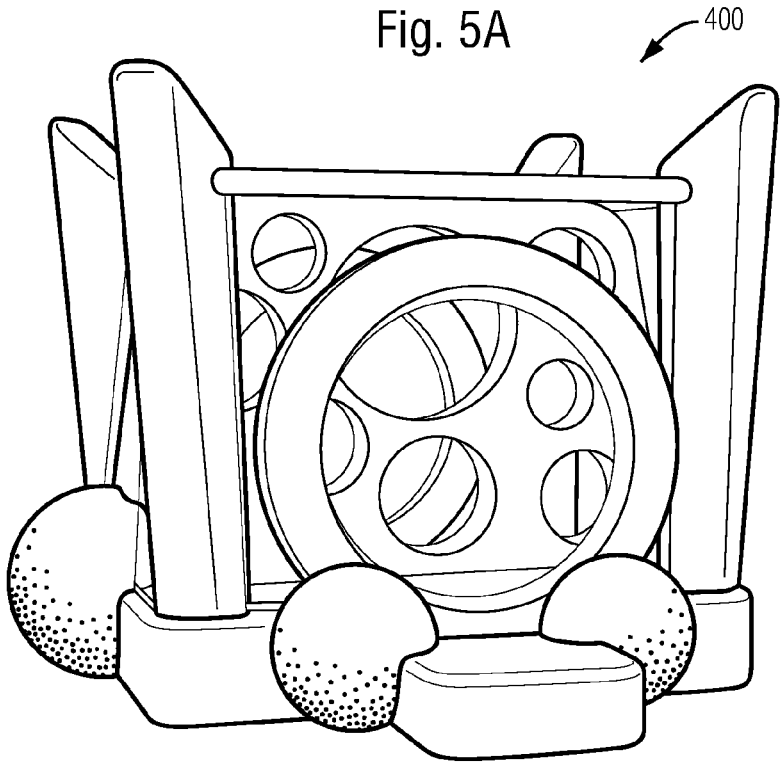
Fig. 5B
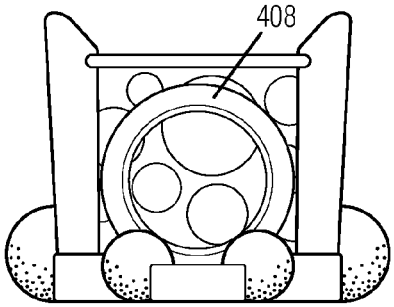
Fig. 5C
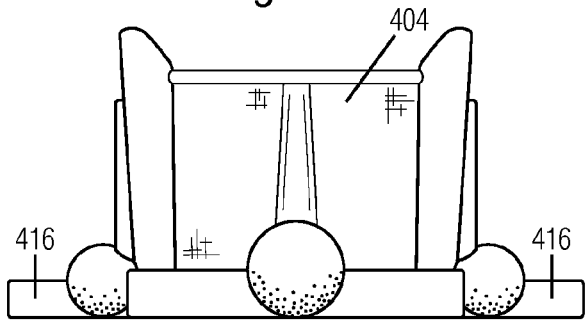
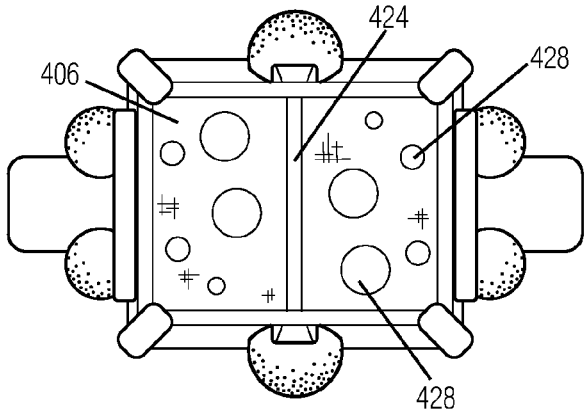
Fig. 5D

Fig. 6A
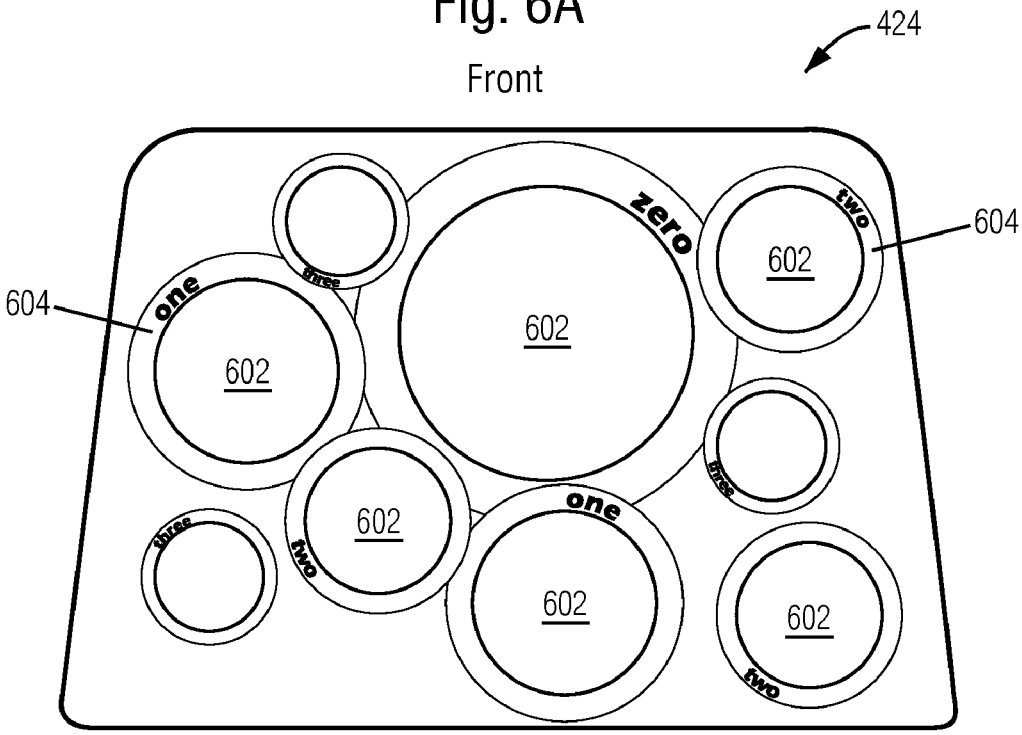
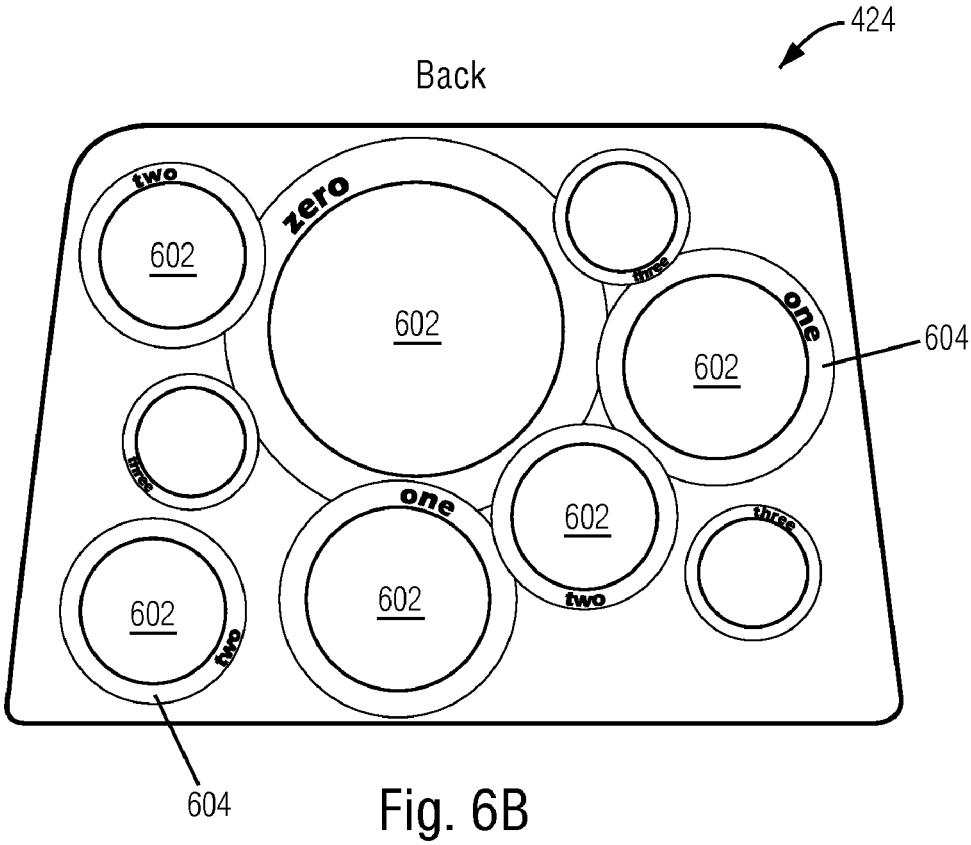
Fig. 6B

METHOD, SYSTEM, AND APPARATUS FOR PROVIDING MULTI-PLAYER COMPETITIVE RECREATION

CROSS-REFERENCE TO RELATED APPLICATIONS

This application is a non-provisional application of U.S. Provisional Application No. 60/707,777, filed on Aug. 12, 2005 and entitled "Method, System, and Apparatus for Enabling Competitive Recreation for Use in Conjunction With a Trampoline or Inflatable," which is expressly incorporated herein by reference in its entirety.

BACKGROUND

There are many forms of games and sports available to children and adults everywhere. One popular activity is jumping on a trampoline. For many years, children and adults have enjoyed jumping on trampolines. Recently, inflatable jumping devices have become increasingly common and popular. For example, the inflatable devices often take the form of jumping castles or simply rectangular jumping rooms. While trampolines and jumping inflatables provide entertainment, simply jumping up and down often becomes repetitive and monotonous without a game or competition to enliven the activity. Children and adults alike enjoy participating in activities when their minds are stimulated through competition rather than participating in activities that simply involve repetition without a specific purpose or goal.

It is with respect to these and other considerations that the various embodiments described herein have been made.

SUMMARY

Aspects of the disclosure presented herein provide multiple players with a unique competitive game. According to one implementation described herein, a game partition has opposing side edges, a top edge, and a bottom edge. Partition material spans the area defined by these edges and includes at least one aperture sized to allow a game ball to pass through. The game partition may include numerous apertures of various sizes. The partition material may be a mesh material.

According to another aspect of the disclosure presented herein, a game system provides competitive recreation to multiple players using at least one game ball. The game system includes a jumping device that may be a trampoline or an inflatable. A game partition attaches to the jumping device, bisecting a jumping surface of the device. The game partition has two opposing side edges, a top edge, and a bottom edge. Partition material attaches to the edges and spans the area defined between the edges. The game partition has at least one aperture that is sized to allow a game ball to pass through. The jumping device may include a jumping arena defined by a front wall, a rear wall, two side walls, a ceiling, and a jumping surface. The game partition divides the jumping arena into two jumping compartments, each having an entryway for entry and exit to and from the jumping compartment. Each entryway may have a sealable opening and an inflatable mat exterior to the jumping compartment.

According to yet another aspect of the disclosure presented herein, a method provides competitive recreation on a jumping apparatus. A game partition is provided to bisect a jumping arena defined by the jumping apparatus. The game partition includes at least one aperture sized to allow a game ball to pass through. The game partition may include a mesh material and may include apertures of different sizes or shapes. Game instructions are provided, directing multiple players to separate into two teams on the jumping arena, with one team on each side of the game partition. The game instructions direct players to project a game ball through an aperture in the game partition and tag a player from the opposing team. The game instructions further direct the players to leave the jumping arena or cease participation in the game upon being tagged by the ball. Players are directed to keep a score for each team, increasing the score according to a point value associated with the aperture through which a game ball is projected before it contacts a player on the opposing team. The winning team is determined to be the team with the highest score at the end of a predetermined amount of play time or the first team to achieve a predetermined score.

These and various other features as well as advantages, which characterize the disclosure presented herein, will be apparent from a reading of the following detailed description and a review of the associated drawings.

BRIEF DESCRIPTION OF THE DRAWINGS

FIGS. 2A-2C are front views of game partitions illustrating various game partition configurations according to various embodiments presented herein;

FIG. 5A is a perspective view of a game system illustrating a jumping arena and game partition according to one embodiment presented herein;

FIG. 5B is a front view of a game system illustrating an entrance to a jumping arena according to one embodiment presented herein;

FIG. 5C is a side view of a game system illustrating two compartments of a jumping arena separated by a game partition according to one embodiment presented herein;

FIG. 5D is a top view of a game system illustrating a ceiling and two compartments of a jumping arena according to one embodiment presented herein;

FIGS. 6A and 6B are front and rear views respectively of a game partition illustrating a configuration of a game partition according to one embodiment presented herein.

DETAILED DESCRIPTION

The following detailed description is directed to a method, system, and apparatus for providing teams of players with novel competitive games and recreational opportunities. These embodiments may be combined, other embodiments may be utilized, and structural changes may be made without departing from the spirit and scope of the implementations described herein. The following detailed description is, therefore, not to be taken in a limiting sense, and the scope of the disclosure presented herein is defined by the pending claims and their equivalents.

A popular game enjoyed by many outside the trampoline arena is dodgeball. Dodgeball typically takes place in a wide open area such as a gymnasium floor, or an open field which allows multiple players, usually 5-10 per team, and adequate distance between the teams which allows the rubber or other soft balls to be thrown at high velocity to "tag" your competitor. When a player is tagged, he or she is eliminated from the game. Likewise, when a player catches a ball thrown at them, the thrower is eliminated from the game. Dodgeball is a game that would be enhanced by the ability of the players to jump around higher than normally possible in order to create more of a three-dimensional aspect to the game, allowing for greater escape possibilities from incoming balls as well as allowing for new angles from which to throw a ball at an opposing player. However, simply playing conventional dodgeball in a confined area such as a trampoline or jumping inflatable (hereinafter "jumping arena"), presents several problems.

Traditional dodgeball is better suited for multiple players per team due to the rule that a player is eliminated when tagged by a ball. Having only two players in a traditional dodgeball game would result in extremely short game durations since the game is over as soon as a player is tagged. However, the limited space available within a jumping arena limits the number of players who can participate in the game. Multiple players on a trampoline is typically considered to be risky due to the possibility of injury. Additionally, the limited distance between opposing players creates a potential safety issue with the rubber balls and the typical velocity in which they are thrown at an opponent. The limited distance in confined areas also makes it far too simple to tag the opponent, making the game less challenging and less fun.

Figure 1:
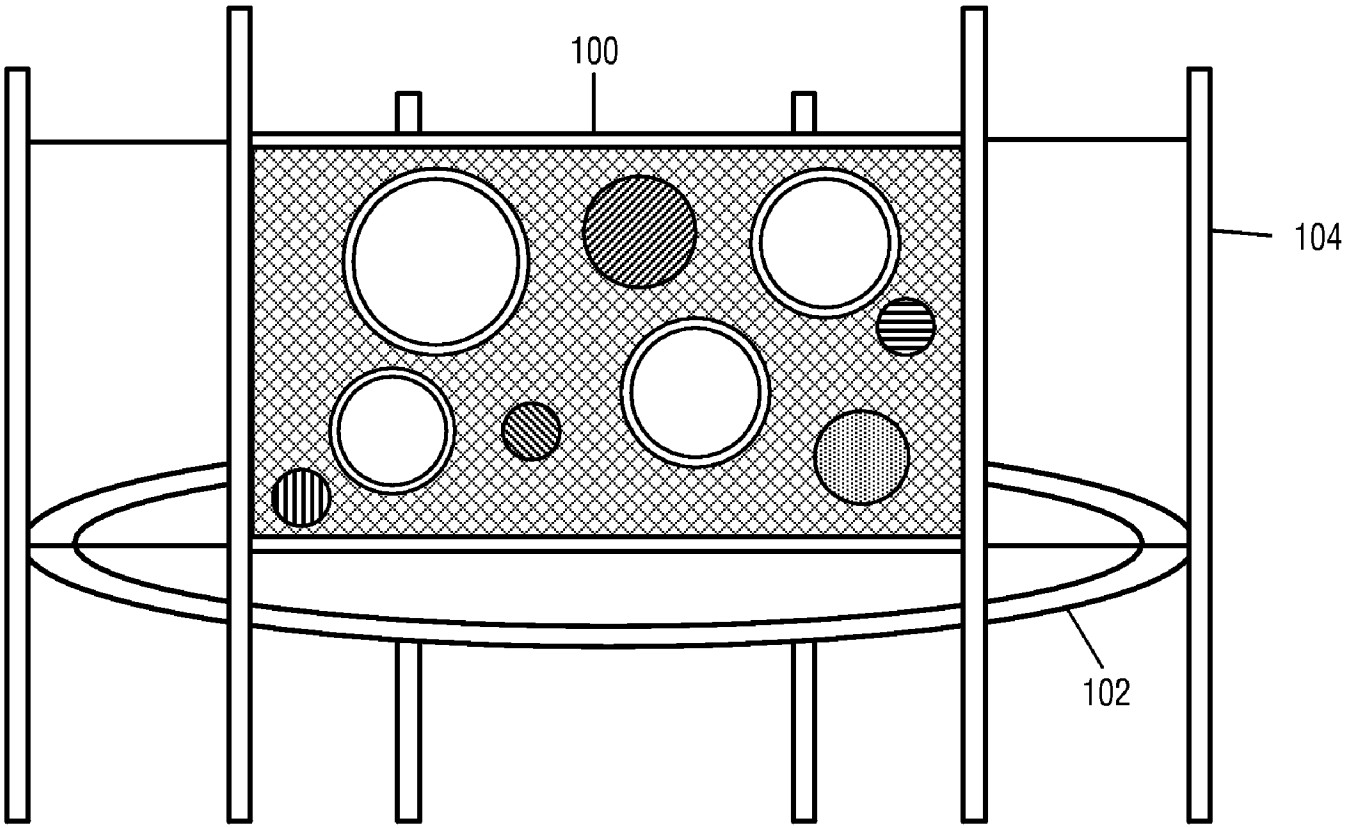
FIG. 1 is a front view of a game partition in use with a trampoline according to one embodiment presented herein.

Referring now to the drawings, in which like numerals refer to like elements through the several figures, aspects of the disclosure presented herein will be described. FIG. 1 shows a game partition 100 in use with a trampoline 102. The game partition 100 is supported to the trampoline posts 104. The method of securing the game partition 100 to the posts 104 is described in detail below with respect to FIG. 3. The trampoline posts 104 are commonly used as part of trampoline systems to support a safety net or cage that surrounds the trampoline 102 to prevent jumpers from falling off. The game partition 100 is designed to be used in conjunction with a typical safety net, but the safety net for trampoline 102 is not shown in FIG. 1 for clarity. As seen in FIG. 1, the game partition 100 has various apertures and configurations that will be discussed in more detail below.

Turning now to FIGS. 2A-2C, various game partitions 200, 216, and 218 are shown. The game partitions 200, 216, and 218 have vertical sides 202 and horizontal sides 204. The horizontal sides 204 are shown in FIGS. 2A-2C to be progressively longer. It should be appreciated that any horizontal side length may be used that is appropriate to the particular size of trampoline or jumping inflatable to which it is to be attached. Similarly, it should be appreciated that the vertical sides 202 may be any length suitable for use with a trampoline or inflatable jumping device. FIGS. 2A-2C show three different game partition configurations based in part on the various surface areas of the game partition. For simplicity, because all three configurations include the same components, the game partition 200 shown in FIG. 2A will be described herein. It should be appreciated that the discussion herein is equally applicable to any game partition configuration.

The game partition 200 is manufactured from mesh 206, allowing air to pass through the game partition and also allowing participants on each side of the game partition to see each other. It is to be understood that the game partition 200 may also be manufactured from any transparent or translucent material other than mesh that allows opposing players to see one another through the game partition. The vertical sides 202 and the horizontal sides 204 are reinforced with reinforcement material 214. The reinforcement material 214 is sewn over the edges of the mesh 206 to improve the durability of the game partition 200 and to provide secure anchoring points for the attachment rings 212. The reinforcement material 214 may be cloth, nylon, vinyl, or any other material suitable for reinforcing the game partition 200 while maintaining the flexible characteristics of the mesh 206. By maintaining flexibility, the game partition 200 may be folded or rolled for storage and transporting, creating a portable game that may be easily used in various locations.

The game partition 200 includes a plurality of apertures 208 and optional designs 210. The designs 210 may be made from any material including mesh, cloth, nylon, vinyl or any other suitable material attached to the mesh 206, or may be imprinted upon the mesh. The designs 210 may be colorful, include various patterns, and may be of any shape or size. The designs 210, while having obvious decorative appeal, may also be functional in that round designs may be made to look like balls coming through the game partition and therefore distract the players, increasing the difficulty of the game.

The apertures 208 are used for throwing a game ball through in an attempt to tag an opposing player. The apertures 208 vary in size and are located in various locations within the game partition 200 depending on the specific configuration. The game partition 200 may be configured with mostly smaller holes in various locations for advanced players, or may be configured with mostly larger holes in the center of the game partition for beginners, or may include any combination of hole size and location for all players. As mentioned above, FIGS. 2A-2C show three different configurations. The apertures 208 have borders that may be any suitable material. The border acts to reinforce the aperture, provide a soft surface to protect a player's arms and hands, and provide a contrast to the mesh in order to increase the visibility of the aperture with regards to the surrounding mesh. Additionally, the apertures 208 may have lighted borders to further provide contrast and to facilitate nighttime play. In this implementation, batteries and wiring may be concealed within a padded border of each aperture such that the lighting is independently controlled for each aperture, or may be wired together in a circuit receiving power from a single battery or external power source. While the apertures 208 are shown as being round, it should be understood that the apertures 208 may be any shape or size, and may be arranged in any location or pattern within a game partition 200 to create any given configuration.

Figure 3:
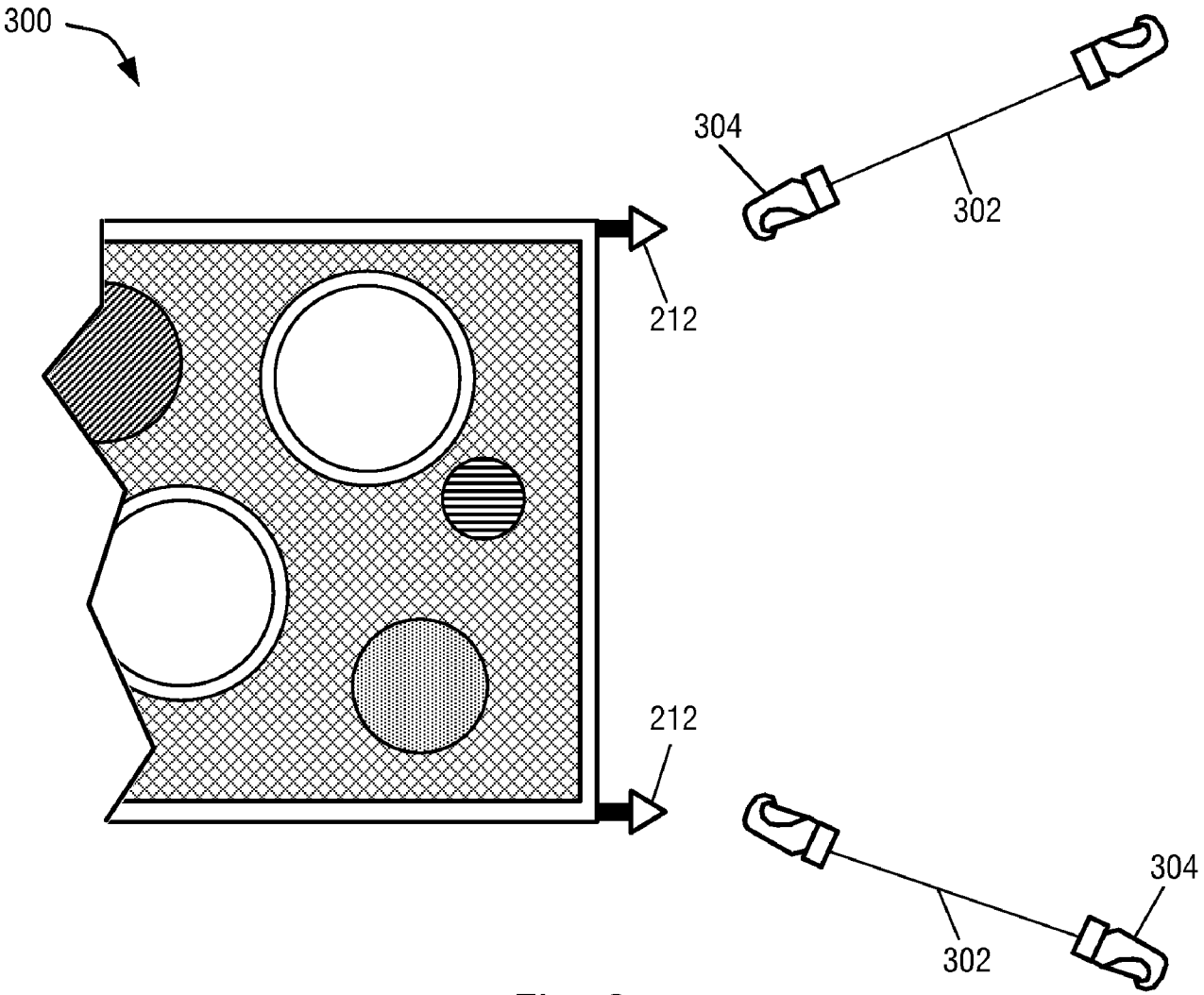
FIG. 3 is a partial view of a game partition illustrating attachment rings with corresponding attachment cords according to embodiments presented herein.
Figure 4A:
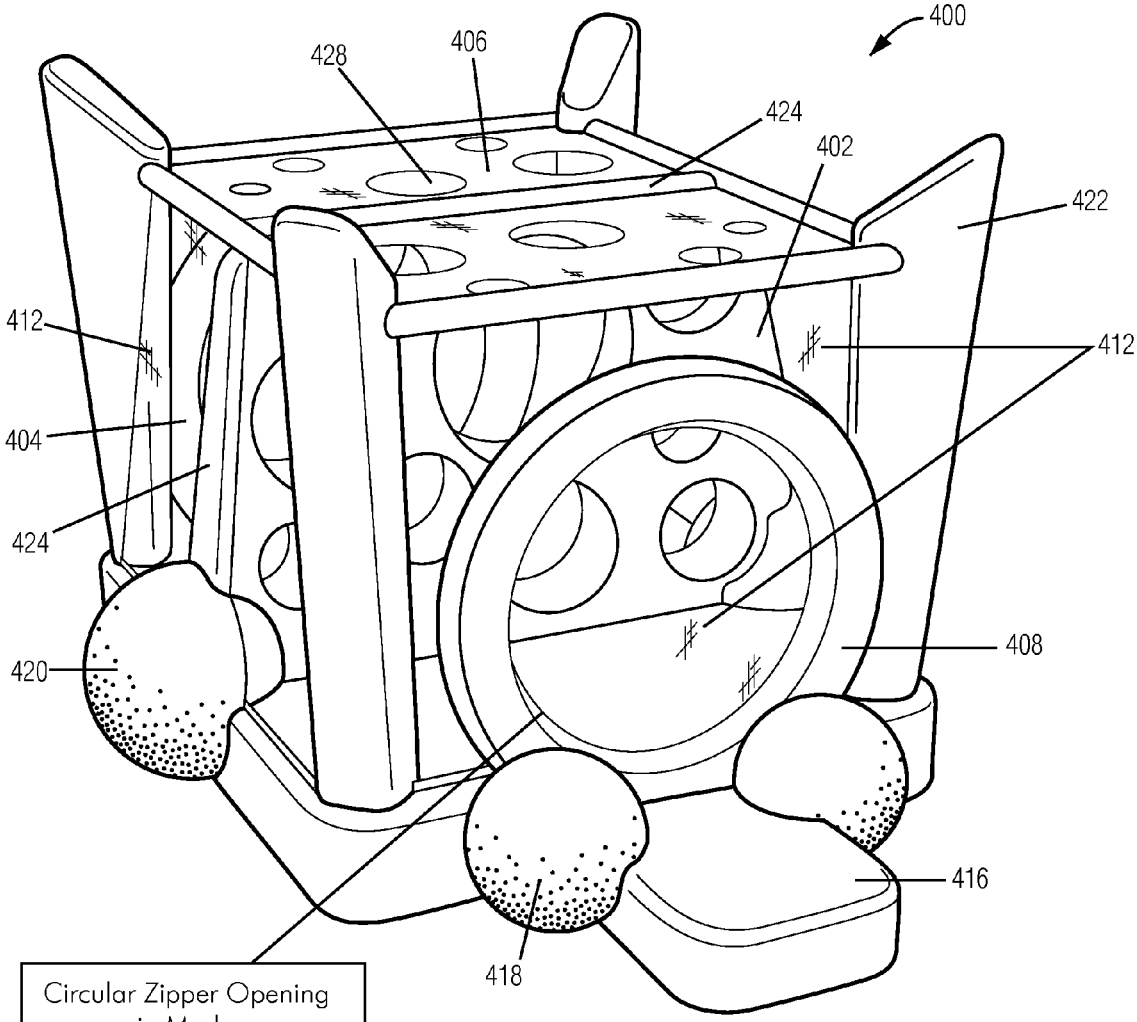
FIG. 4A is a perspective view of a game system illustrating a jumping arena, game partition, and ceiling according to one embodiment presented herein.
Figure 4B:
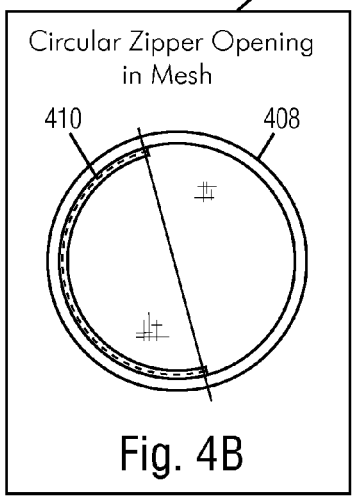
FIG. 4B is a front view of an entryway to a jumping arena illustrating an entrance configuration according to one embodiment presented herein.

The game partition 200 has attachment rings 212 located in each corner of the game partition for attaching the game partition to a trampoline post 104 or the jumping inflatable. FIG. 3 shows partial view of a game partition 300 with attachment rings 212. While the rings 212 are shown in the drawings as triangle rings, it is to be appreciated that the rings 212 may be D-rings, circular rings, or any shaped device that allows a hook to be attached. The rings 212 are preferably sewn onto tabs that are secured to the corners of the game partition 300. As shown in FIG. 3, the rings 212 may be secured to a trampoline post 104 or any other post or inflatable with a corresponding ring using cords 302. The cords 302 are fabric covered shock cord with hooks attached to both ends. The cords 302 may be of various lengths depending on the length of the horizontal side 204 of the game partition 300 and the length of the span across the center of the trampoline 102 or the jumping inflatable to which the game partition will be attached.

The hook 304 is a glass-reinforced nylon hook rigidly or rotatably attached to an end cap that is secured to the cord 302. The hook 304 is preferably biased toward a closed position to prevent the attachment ring 212 from disengaging the hook 304 until steps are taken to remove the ring from the hook. It is to be understood, however, that any hook or any other fasteners may be used to secure the corners of the game partition 300 to the trampoline or the jumping inflatable. The cord 302 comprises an elastic core covered by fabric for protection of the core. Alternatively, rubber cords may be used as well as bungee cords, or any other cords manufactured from materials with elastic properties.

FIGS. 4A-5D show an alternative implementation, wherein a jumping arena 400 provides an all-encompassing system in which to play a multi-player competitive game as described herein without utilizing a separate trampoline or inflatable. The jumping arena 400 is inflatable and includes a front 402, sides 404, ceiling 406, and a rear side that mirrors the front. The jumping arena 400 has entryways 408 on each of the front side 402 and opposing rear side. The entryway 408 is preferably circular with sufficient diameter to facilitate entry of a child or adult, but may be made in any shape and size. The entryway 408, entry mat 416, corners, floor, game partition 424, support balls 418 and 420, and all interconnecting braces are inflatable, while the front 402, sides 404, and rear are preferably a mesh material or other material that allows for ventilated support. Additionally, the game partition 424 is also mesh material attached to inflatable sides. As seen in FIG. 4B, the entryway 408 includes zippered mesh to allow entry and exit while preventing game balls from leaving the arena. To facilitate entry and exit, the zipper 410 begins at a location 15 degrees from top center of the entryway 408 and progresses around the perimeter 180 degrees. It is to be understood that zipper 410 may begin and end at any location at the entryway 408 or that the mesh within the entryway 408 may be secured using hook and loop fasteners, snaps, or any other suitable means for opening and closing the entrance.

The entry mat 416 is an inflatable surface that protrudes from the arena and facilitates entry and exit. The support balls 418 prevent children from falling out of the arena at the entrance while providing a pleasing aesthetic feature to the arena. The support balls 420 provide additional support for the arena at a central location of the jumping arena 400. As seen in FIG. 5D, the ceiling 406 includes a plurality of apertures 428. These apertures allow for air and light penetration and may be optionally covered with mesh 412. It is to be understood that ceiling 406 is optional, and if present, may be made out of plastic, vinyl, nylon, cloth, or mesh. The ceiling 406 may be water-resistant to allow for continued play within the jumping arena while lightly raining outside the arena.

The game partition 424, shown in FIGS. 6A and 6B, bisects the arena to create two chambers. As discussed above, each chamber has its own entryway 408. The game partition 424 may be primarily inflatable or mesh. The game partition 424 may be secured to the inside of the jumping arena 400 using similar means as those discussed above with respect to FIG. 3, or may be a permanent fixture within the jumping arena 400. The game partition 424 includes a plurality of apertures 602 and designs as discussed above with respect to the game partitions shown in FIGS. 1-3. To alter the difficulty of a game, the apertures 602 may be covered by mesh to prevent their use. In doing so, larger apertures may be covered to increase the difficulty or smaller apertures may be covered to decrease the difficulty. As seen in FIGS. 6A and 6B, the apertures 602 may be assigned point values 604 corresponding to the difficulty of the particular aperture. Point values will be discussed more below with respect to example game rules.

Figure 7:
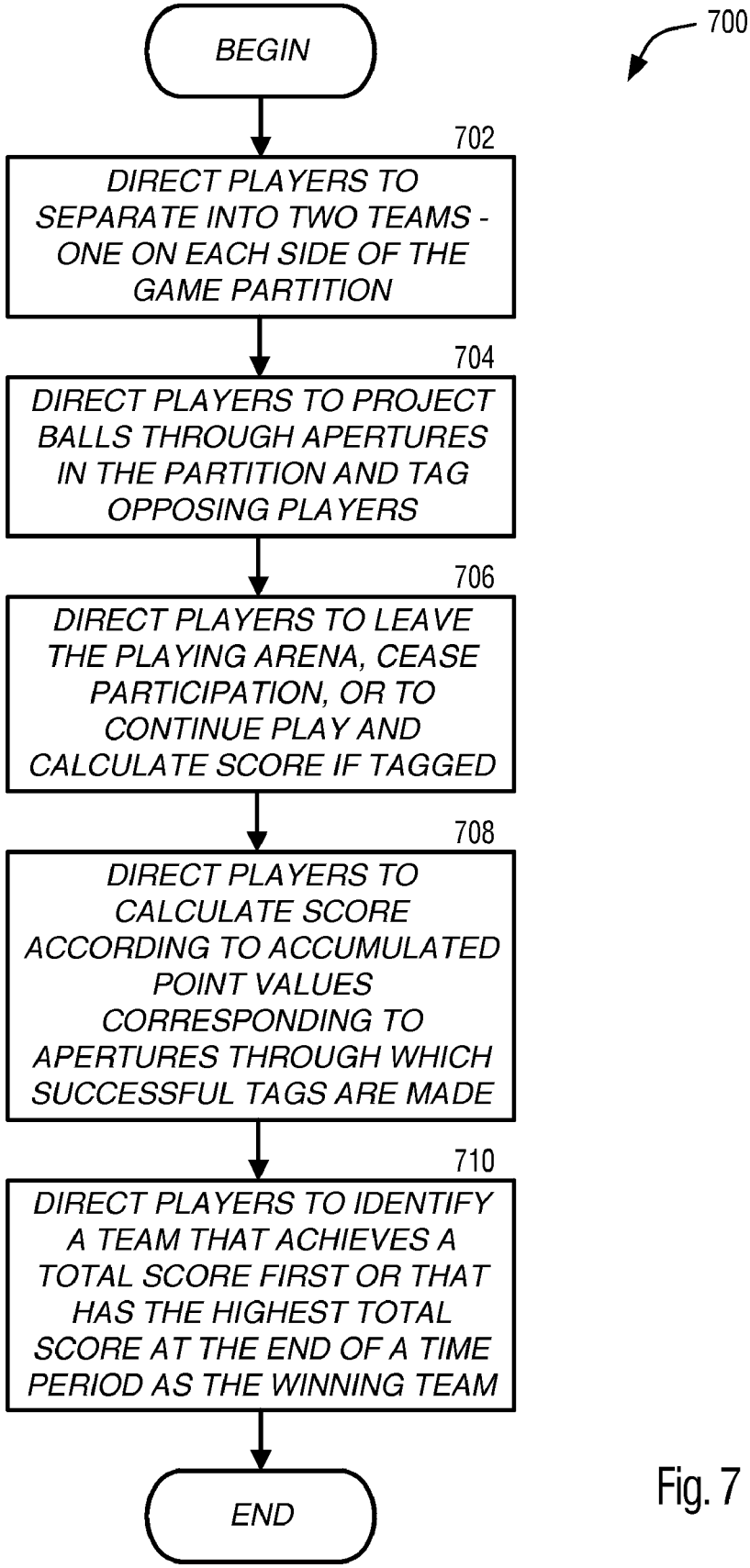
FIG. 7 is a flow diagram illustrating a method for instructing players on playing a game using the apparatus and systems disclosed herein according to various embodiments presented herein.

As described above, the game partition 100 and jumping arena 400 may be used to play a competitive game developed for use by multiple players in a trampoline or jumping inflatable. FIG. 7 shows an illustrative routine 700 for providing game instructions to players for utilizing a game partition or jumping arena as described above according to implementations described here. The routine 700 begins at operation 702, where players are directed to separate into two teams, with the teams on either side of the game partition. The routine 700 continues from operation 702 to operation 704, where players are directed to project balls through apertures in the game partition in an effort to tag players on the opposing team. From operation 704, the routine 700 proceeds to operation 706, where players are given directions as to what action to take if tagged by a ball.

There are three options shown, but any action may be directed depending on the desired play style. First, if tagged, a player may be directed to leave the playing arena. Second, a player may be directed to cease participation in the game, but remain in the playing arena. The tagged player may simply sit against a wall or in a corner of the playing arena until the current game has been won. A third option directs a tagged player to continue play, but to count the points scored as a result of the tag as is directed at operation 708. At operation 708, the score is calculated by adding points to a teams total according to the point value of an aperture through which a game ball is thrown that tags a player after passing through the aperture. If a ball is caught, that point value goes to the catching team's total as opposed to the throwing team's total or may be subtracted from the throwing team's total. From operation 708, the routine 700 proceeds to operation 710, where players are directed to identify a winning team by one of two methods and then the routine ends. The first method for determining a winning team is that the winning team is the team that achieves a predetermined total score first. For example, the first team to gain 15 points wins. The second method for determining a winning team is to play the game for a predetermined amount of time and the team with the highest point total at the end of the time period wins.

As discussed above, each aperture has a point system based on the size and difficulty of the aperture. Example: a 16" hole that is positioned in a corner might generate 3 points if the player throws the ball through the hole and tags the opponent. A larger hole might only bring 2 points to tag the player.

A typical scoring system for a game includes
- 20 inch hole=1 point
- 16 inch hole=2 points
- 12 inch hole=3 points
- Player touches the partition=−1 point
- Player tags opponent in the face=−3 points Players agree on the number of sets to play and the winning score for each set. As an example, players might agree to play 3 sets with 11 points winning a set and with the best of 3 sets winning the overall match. To alter the difficulty, different game partitions with different aperture size and location configurations may be used, or alternatively, mesh may be used to cover existing apertures.

As an alternative game, players may play a modified version of the common "Horse" basketball game. In Horse, players attempt to make shots that an opponent has made. If a shot is missed after an opponent has made it, the person that missed gets a letter, for example, "H." The game continues until a person spells "Horse" and loses the game. Using the jumping arena or the game partitions described above, players can attempt to throw a ball through certain apertures while standing or jumping in a certain location. If a person makes a shot and an opponent subsequently misses the shot, then the person making the shot gets the appropriate number of points for that aperture. The winner is the first person to reach a particular score.

Although the subject matter presented herein has been described in conjunction with one or more particular embodiments and implementations, it is to be understood that the invention defined in the appended claims is not necessarily limited to the specific structure, configuration, or functionality described herein. Rather, the specific structure, configuration, and functionality are disclosed as example forms of implementing the claims.

The subject matter described above is provided by way of illustration only and should not be construed as limiting. Various modifications and changes may be made to the subject matter described herein without following the example embodiments and applications illustrated and described, and without departing from the true spirit and scope of the present invention, which is set forth in the following claims.

What is claimed is:

1. A game system for providing a plurality of players competitive recreation using at least one game ball, comprising:

an inflatable jumping device comprising a jumping surface, a jumping arena defined by a front wall, a rear wall, a first side wall, a second side wall, a ceiling, and the jumping surface, a first jumping compartment within the jumping arena defined by a game partition, the front wall, the first side wall, the second side wall, the ceiling, and the jumping surface, a second jumping compartment within the jumping arena defined by the game partition, the rear wall, the first side wall, the second side wall, the ceiling, and the jumping surface, a first entryway to the first jumping compartment, and a second entryway into the second jumping compartment; and the game partition configured for attaching to the inflatable jumping device such that the game partition bisects the jumping surface, the game partition characterized by a first side edge, a second side edge opposite the first side edge, a top edge abutting the first and second side edges, a bottom edge opposite the top edge and abutting the first and second side edges, and a partition material attached to the first side edge, the second side edge, the top edge, and the bottom edge such that the partition material spans an area defined by the first side edge, the second side edge, the top edge and the bottom edge, and wherein the partition material comprises a plurality of apertures comprising a plurality of aperture sizes, each aperture size configured to allow the at least one game ball to pass through the partition material.

2. The game system of claim 1, further comprising a plurality of game balls.

3. The game system of claim 1, wherein the game partition is removably attached to the jumping device.

4. The game system of claim 1, wherein the first edge, the second edge, the top edge, and the bottom edge are inflatable.

5. The game system of claim 1, wherein each of the first and second entryways comprises a sealable opening to the corresponding jumping compartment and an inflatable mat on a side of the sealable opening exterior to the jumping compartment.

6. A game system for providing a plurality of players competitive recreation using at least one game ball, comprising:

an inflatable jumping device comprising a jumping surface, four contiguous walls surrounding the jumping surface, and an inflatable mat contiguous with the jumping surface at each of two separate entrances of two jumping compartments;

a game partition configured to bisect the jumping surface to create the two jumping compartments, the two jumping compartments each defined by three of the four contiguous walls and comprising separate entrances, wherein the game partition comprises a plurality of apertures, the plurality of apertures comprising a plurality of aperture sizes and positioned within the game partition at a plurality of distances from the jumping surface; and a plurality of inflatable support balls attached to the inflatable jumping device at positions where each inflatable mat abuts the jumping surface on opposite sides of each entrance such that each inflatable support ball provides an obstruction that is configured to prevent a person from falling off of a side of the inflatable mat at the entrance.

7. The game system of claim 6, wherein the plurality of apertures further comprise a plurality of shapes.

8. The game system of claim 6, wherein the game partition is detachable.

9. The game system of claim 6, further comprising a plurality of inflatable support balls attached to the inflatable jumping device and configured to provide structural support to the inflatable jumping device.

* * * * *